United States Patent [19]

Crum

[11] Patent Number: 4,602,769

[45] Date of Patent: Jul. 29, 1986

[54] APPARATUS FOR THE COOLING OF ARTICLES WHICH HAVE BEEN SUBJECTED TO AN ISOSTATIC PRESSING PROCESS

[75] Inventor: Andrew S. D. Crum, Warren, Pa.

[73] Assignee: National Forge Company, Andover, Mass.

[21] Appl. No.: 724,203

[22] Filed: Apr. 17, 1985

[30] Foreign Application Priority Data

May 11, 1984 [BE] Belgium ..... 212916

[51] Int. Cl.[4] ..... C21D 9/00; F27B 5/04

[52] U.S. Cl. ..... 266/259; 425/405 H; 432/205

[58] Field of Search ..... 425/78, 405 H; 266/249, 266/251, 252; 432/199, 205; 110/207

[56] References Cited

U.S. PATENT DOCUMENTS

| | | | |
|---|---|---|---|
| 2,636,752 | 4/1953 | Schane et al. | 285/106 |
| 3,470,624 | 10/1969 | Plotkowiak | 34/20 |
| 3,548,062 | 12/1970 | Smith, Jr. | 13/20 |
| 3,628,779 | 12/1971 | Lundstorm | 266/5 E |
| 3,900,189 | 8/1975 | Elmgren et al. | 266/5 E |
| 3,940,245 | 2/1976 | Smith, Jr. et al. | 432/249 |
| 4,022,446 | 5/1977 | Smith, Jr. et al. | 266/252 |
| 4,217,087 | 8/1980 | Bowles | 425/78 |
| 4,235,592 | 11/1980 | Smith, Jr. et al. | 432/205 |
| 4,349,333 | 9/1982 | Bowles | 432/205 |
| 4,359,336 | 11/1982 | Bowles | 75/226 |

OTHER PUBLICATIONS

Perry, J. H., Chemical Engineer's Handbook, pp. 6-2, 6-29-6-31, 1963.

*Primary Examiner*—Christopher W. Brody

*Attorney, Agent, or Firm*—Jeffrey H. Ingerman; Charles B. Smith

[57] ABSTRACT

Apparatus for the cooling of articles which have been subjected to an isostatic pressing process is provided. The apparatus includes an injector system which is connected with a fresh gas supply conduit, and with passages along which the gases are drawn from the interior of the apparatus by the injector system, all in such a manner that a circulation of gas can be maintained in the pressure chamber, primarily between the top and bottom regions of the apparatus.

20 Claims, 1 Drawing Figure

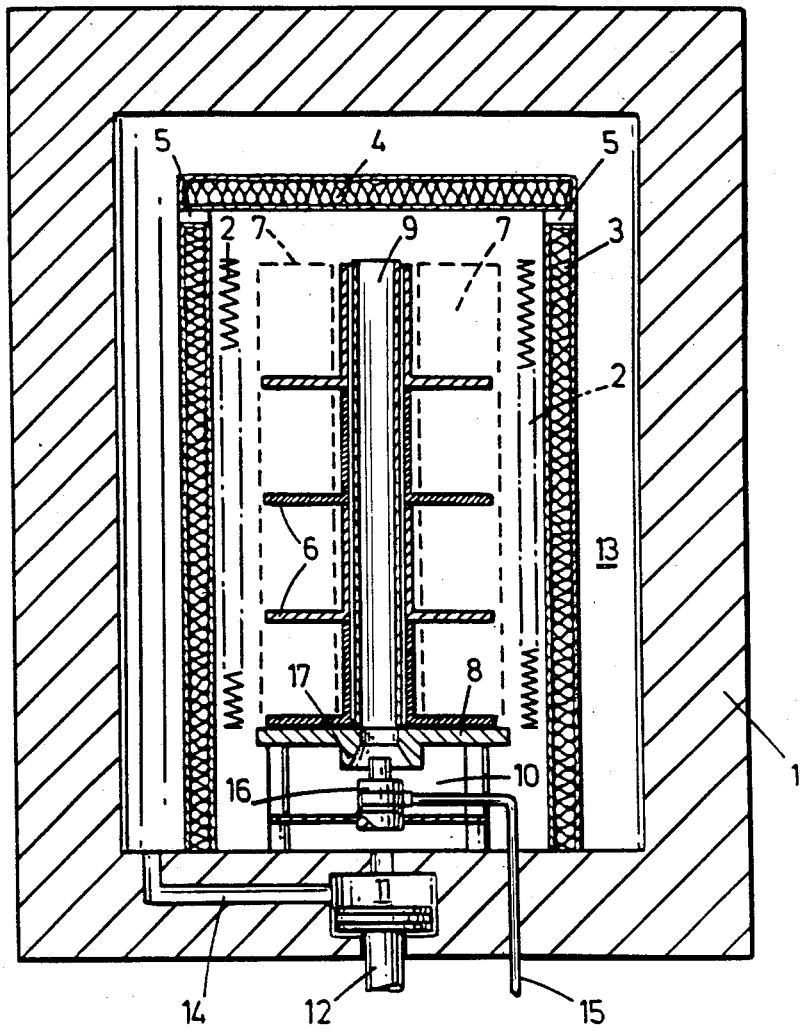
5
4
5
2
7
9
7
3
2
6
13
17
8
1
16
10
11
14
12
15

APPARATUS FOR THE COOLING OF ARTICLES WHICH HAVE BEEN SUBJECTED TO AN ISOSTATIC PRESSING PROCESS

BACKGROUND OF THE INVENTION

This invention relates to an apparatus for the post-treatment, particularly the cooling, of articles which have been subjected to an isostatic pressing process in which the articles are subjected to high temperatures and pressures in a pressure chamber while stacked in a loading can which is located in a heating furnace.

In the treatment of articles by the isostatic pressing method, the articles are subjected to high pressures of from about 500 to about 2000 bar and high temperatures of from about 500° C. to about 2000° C. while stacked on a loading can or loading rack. This loading can rests on a base in the center of a furnace which is contained in a closed pressure chamber. The furnace is generally formed of a network of electrical resistors which, in turn, is surrounded by a thermal insulating screen. A number of passages for the circulation of gas during the cooling phase are generally provided at the top of the insulating screen. A device equipped with a furnace of the type described generally consists primarily of a cylindrical pressure chamber with a vertical axis, the wall thickness of which is sufficient to withstand the high gas pressures developed in the apparatus.

In order to accelerate the cooling phase, it is known to provide a cooling valve at the bottom of the pressure chamber. A series of opening or pipes connect this cooling valve, and in particular the valve housing thereof, to a space around the insulating screen. These pipes discharge into the bottom of the pressure chamber which is filled with argon or another suitable inert gas.

When the valve is closed, cooling by natural convection is prevented. When the valve is open, cooling by natural convection takes place by circulation of the gas in the pressure chamber. The gas circulates from the bottom of the pressure chamber, at the level of the valve housing, towards the higher regions of the furnace. The gas flows out of the furnace proper through holes or openings provided at the top in the insulating wall of the furnace to the circular space between the furnace and the wall of the pressure chamber.

The circulation of the gas by natural convection is not, in itself, sufficient to promote the rapid cooling of the treated molded articles. This is because the use of the known structure produces a stratification phenomenon at the top of the pressure chamber with the result that the very hot gases stabilize themselves at the top of the pressure chamber and the less hot gases stabilize themselves at the bottom of the pressure chamber and in the furnace.

Further problems arise in this connection because the rate of cooling is dependent on the physical properties of the gas used, such as the density/temperature relationship, which may result in nonuniform cooling of the articles stacked in the furnace. The physical structure of the treated product may not be the same for all of the articles because of different or diverging cooling gradients.

The object of the present invention is to overcome these and similar drawbacks of known apparatus and to provide an apparatus in which a considerably faster cooling of articles, under very similar circumstances, can be expected.

SUMMARY OF THE INVENTION

The apparatus according to the invention comprises a pressure chamber having inner walls, a furnace within and spaced from said inner walls, and an insulating screen between and spaced from said furnace and said inner walls. The pressure chamber has at its bottom end a second chamber which is provided with an injector or venturi which is placed above the valve which controls the passages which connect the space between the outer and inner walls of the insulating screen, all in such a manner that when the valve is opened, circulation of gas takes place and is maintained between the inside and outside of the insulating screen. The injector or venturi is connected to a high-pressure line outside the pressure chamber so that fresh gas can be fed along it to the injector by means, for example, of a compressor. The introduction of fresh gas along this line to the injector causes the injector to draw in additional gas through the valve and the passages which connect the spaces inside and outside the walls of the insulating screen. The freshly introduced gas is normally cooler than the gas present in the pressure chamber, but is usually otherwise identical. The freshly introduced gas mixes with the gas drawn in through the valve and this mixed quantity of gas is conducted through the venturi into the furnace. In accordance with one embodiment of the invention, a pipe extends over substantially the entire length of the furnace and the mixed gas is conducted by the venturi into the pipe. In a particularly preferred embodiment, the pipe can be provided with outlets at different levels.

BRIEF DESCRIPTION OF THE DRAWING

Other details and advantages of the invention will become evident from the following description, taken in conjunction with the accompanying FIGURE, which is a schematic vertical cross-sectional view taken along the axis of the apparatus.

DETAILED DESCRIPTION OF THE INVENTION

The apparatus of the invention consists primarily of a pressure chamber 1 which is shown schematically as a closed space but which is actually provided on top with a hermetic closure.

Within the pressure chamber 1 there is mounted a furnace consisting of electric resistors 2 which can be distributed in one or more zones over the length of the pressure chamber 1. Between the furnace and the walls of pressure chamber 1 there is a cylindrical thermal insulating wall 3 having an insulating cover 4. Between the insulating cover 4 and the insulating wall 3, openings 5 are provided to allow pressure equilization during the isostatic pressing process and to permit the circulation of the gases between the inside of furnace and the cylindrical space 13 between the outer wall of the insulating screen 3 and the inner wall of the pressure chamber 1.

The articles 7 which have been subjected to the isostatic pressing process are stacked on a loading can 6, which rests on a base 8. In the center, through this base and along the axis of the apparatus, there extends in a preferred embodiment a pipe 9 which may or may not be perforated and which connects at the bottom thereof with a chamber 10 which in turn connects with the valve housing 11 of a valve 12.

The valve housing 11 is connected with the space 13 between the inner walls of pressure chamber 1 and the insulating wall 3 of the furnace by a series of passages 14.

As described above, the closing of valve 12 prevents the circulation of gases from the furnace load region. When valve 12 is opened, the heated gases can escape through opening 5 and circulate along space 13 between the outer wall of insulating screen 3 and the inner wall of pressure chamber 1, through passages 14 to valve housing 11, and from there to the chamber 10 and the pipe 9. Such a structure is already known but achieves too slow a cooling of the gases and therefore of the articles.

According to the invention, a conduit 15 is provided to supply gas under pressure. Conduit 15 discharges within chamber 10 into an injector or venturi 16 which mixes the gas introduced through conduit 15 with the gas drawn in through the valve housing 11 and directs it into a conical bottom terminating portion 17 of pipe 9.

As a result of this structure, for a given volume of fresh gas introduced through conduit 15, a volume of gas several times greater than the volume of fresh gas can be circulated in the furnace and in pressure chamber 1, provided that valve 12 is open. By the venturi effect, a rapid displacement of the gases through pipe 9 is obtained. The mixture of fresh gas fed through conduit 15 with the gas present in pressure chamber 1 therefore circulates rapidly and uniformly through the entire apparatus. For this purpose the pipe 9 can be perforated, having openings at many levels, which assures a better distribution of the gas.

As the cool gas introduced by the injector cools the articles in the furnace, it absorbs heat. After the gas passes through the furnace, it passes into space 13 where it is cooled by contact with the inner walls of pressure chamber 1 or by a heat exchanger (not shown) in the top closure of pressure chamber 1, in a known manner.

The new structure according to the invention provides, inter alia, the following advantages:

1. Cooling by convection depends on the energy introduced by the fresh gas. The convection phenomenon is maintained even in the absence of a temperature gradient between the loading can and the pressure chamber.

2. The amount of convection, and therefore the extent of the cooling, depends on the rate with which fresh gas is introduced, so that cooling can be regulated by controlling said rate.

3. The mixture of freshly introduced gas and gas present in the pressure chamber has sufficient kinetic energy to overcome the static pressure of the gas in the top part of pipe 9. In this way, cold gas can be introduced in the hottest part of the apparatus, whence the gas mixture will be displaced downward by gravity. During this downward displacement of the cooling gas, the articles are also cooled. All stratification phenomena in pressure chamber 1 and in the furnace are thereby completely avoided.

The preferred embodiment described above is presented for purposes of illustration, rather than limitation. Those skilled in the art will recognize that the inventive principles discussed herein can be practiced with apparatus other than that specifically described above.

What is claimed is:

1. Apparatus for the post-treatment of articles which have been subjected to high temperature and pressure in an isostatic pressing process, said apparatus comprising:

a pressure chamber having inner walls and having gas therewithin;

a furnace within and spaced from said inner walls of said pressure chamber;

a loading can for stacking said articles within said furnace;

an insulating screen between and spaced from said furnace and said inner walls of said pressure chamber;

a second chamber having an injector therein in communication with said furnace;

a gas supply conduit supplying said injector with fresh gas, said fresh gas being cooler than the gas within said pressure chamber;

at least one passage communicating between said second chamber and the space between said insulating screen and said inner walls of said pressure chamber; and a valve disposed in the end of said passage adjacent said second chamber;

said injector drawing gas from said second chamber through said valve and said passage, and from said supply conduit, for maintaining gas circulation and preventing gas stratification in said pressure chamber when said valve is open.

2. Apparatus for the post-treatment of articles which have been subjected to high temperature and pressure in an isostatic pressing process, said apparatus comprising:

a pressure chamber having inner walls and having gas therewithin;

a furnace within and spaced from said inner walls of said pressure chamber;

a loading can for stacking said articles within said furnace;

an insulating screen between and spaced from said furnace and said inner walls of said pressure chamber;

a pipe extending over substantially the entire length of said furnace, said pipe being open at both ends thereof;

a second chamber connected to one end of said pipe, said second chamber having an injector therein in communication with said pipe;

a gas supply conduit supplying said injector with fresh gas, said fresh gas being cooler than the gas within said pressure chamber;

at least one passage communicating between said second chamber and the space between said insulating screen and said inner walls of said pressure chamber; and a valve disposed in the end of said passage adjacent said second chamber;

said injector drawing gas from said second chamber through said valve and said passage, and from said supply conduit, and injecting it through said pipe for maintaining gas circulation and preventing gas stratification in said pressure chamber when said valve is open.

3. The apparatus of claim 2 wherein said loading can is in the center of said furnace, said furnace is in the center of said pressure chamber, said pipe extends substantially along the central vertical axis of said pressure chamber, said furnace and said loading can, and said second chamber is at the bottom of said pipe; said gas circulation being between the top and bottom regions of said pressure chamber.

4. The apparatus of claim 1 comprising a plurality of said passages.

5. The apparatus of claim 2 comprising a plurality of said passages.

6. The apparatus of claim 3 comprising a plurality of said passages.

7. The apparatus of claim 1 wherein said injector comprises a venturi device, said fresh gas being supplied to said injector through said supply conduit at high pressure, whereby said venturi device draws gas through said passage.

8. The apparatus of claim 2 wherein said injector comprises a venturi device, said fresh gas being supplied to said injector through said supply conduit at high pressure, whereby said venturi device draws gas through said passage.

9. The apparatus of claim 3 wherein said injector comprises a venturi device, said fresh gas being supplied to said injector through said supply conduit at high pressure, whereby said venturi device draws gas through said passage.

10. The apparatus of claim 4 wherein said injector comprises a venturi device, said fresh gas being supplied to said injector through said supply conduit at high pressure, whereby said venturi device draws gas through said passages.

11. The apparatus of claim 5 wherein said injector comprises a venturi device, said fresh gas being supplied to said injector through said supply conduit at high pressure, whereby said venturi device draws gas through said passages.

12. The apparatus of claim 2 wherein said pipe has orifices spaced along its length for circulating gas to different regions of said pressure chamber.

13. The apparatus of claim 3 wherein said pipe has orifices spaced along its length for circulating gas to different regions of said pressure chamber.

14. The apparatus of claim 4 wherein said pipe has orifices spaced along its length for circulating gas to different regions of said pressure chamber.

15. The apparatus of claim 5 wherein said pipe has orifices spaced along its length for circulating gas to different regions of said pressure chamber.

16. The apparatus of claim 6 wherein said pipe has orifices spaced along its length for circulating gas to different regions of said pressure chamber.

17. The apparatus of claim 8 wherein said pipe has orifices spaced along its length for circulating gas to different regions of said pressure chamber.

18. The apparatus of claim 9 wherein said pipe has orifices spaced along its length for circulating gas to different regions of said pressure chamber.

19. The apparatus of claim 10 wherein said pipe has orifices spaced along its length for circulating gas to different regions of said pressure chamber.

20. The apparatus of claim 11 wherein said pipe has orifices spaced along its length for circulating gas to different regions of said pressure chamber.

* * * * *